United States Patent [19]

Garrett

[11] Patent Number: 5,048,423

[45] Date of Patent: Sep. 17, 1991

[54] CARTRIDGE CASE FOR TELESCOPED AMMUNITION ROUND

[75] Inventor: Harold E. Garrett, Santa Ana, Calif.

[73] Assignee: Loral Aerospace Corp., New York, N.Y.

[21] Appl. No.: 570,833

[22] Filed: Jul. 6, 1990

Related U.S. Application Data

[63] Continuation of Ser. No. 290,597, Dec. 27, 1988, abandoned.

[51] Int. Cl.[5] ..... F42B 5/045

[52] U.S. Cl. ..... 102/434; 102/430; 102/464; 102/493

[58] Field of Search ..... 102/430, 433, 434, 444, 102/464, 465, 466, 467, 468, 493

[56] References Cited

U.S. PATENT DOCUMENTS

| | | | |
|---|---|---|---|
| 2,362,738 | 11/1944 | Yarbrough | 102/430 |
| 2,546,705 | 10/1965 | Langenohl et al. | 102/520 |
| 3,339,487 | 9/1967 | Stadler et al. | 102/444 |
| 4,015,527 | 4/1977 | Evans . | |
| 4,197,801 | 4/1980 | Lafever et al. . | |
| 4,335,657 | 6/1982 | Bains . | |
| 4,604,954 | 8/1986 | Clarke et al. . | |
| 4,681,038 | 7/1987 | Washburn | 102/464 |
| 4,802,415 | 2/1989 | Clarke et al. | 102/434 |

*Primary Examiner*—Harold J. Tudor

*Attorney, Agent, or Firm*—Edward J. Radlo; John S. Ferrell; Randolph A. Smith

[57] ABSTRACT

A cartridge case for a telescoped ammunition round has a generally tubular case wall and an axially extending elongate score line in said wall to provide pressure relief during firing of the round. The elongate score line has a radial depth less than the radial thickness of the wall.

4 Claims, 2 Drawing Sheets

CARTRIDGE CASE FOR TELESCOPED AMMUNITION ROUND

This is a continuation of copending application(s) Ser. No. 07/290,597 filed on Dec. 27, 1988, now abandoned.

This invention is related, in part, to the subject matter of U.S. patent application Ser. No. 251,610 filed Sept. 30, 1988 which is commonly assigned herewith.

BACKGROUND OF THE INVENTION

1. Field of the Invention

This invention relates to a cartridge case for a telescoped ammunition round and, more particularly, to a cartridge case providing improved handling characteristics for spent rounds.

2. Discussion of the Related Art

Telescoped ammunition is well known in the ordnance art. Typically, a telescoped ammunition round includes a propellant charge having an axial bore or cavity, a projectile housed within, usually entirely within, the axial bore of the propellant charge and a tubular case around the outside of the propellant charge forming the exterior surface of the round. When a telescope round of ammunition is loaded into the firing chamber of a gun, the projectile, being housed within the propellant charge, is not seated in the barrel of the gun as would be the projectile of a round of conventional ammunition.

When the telescoped round is fired, the projectile is forced forward into the barrel of the gun and becomes seated in the barrel. The firing force is also applied as an outward force to the case and, accordingly, tends to cause radially outward deformation or deflection of the case. It is generally understood that during firing these forces cause not only an increase in the diameter of the case, but also a corresponding increase in diameter of the firing chamber. After firing, the firing chamber returns to its original dimensions. The tubular case of the telescoped ammunition round, e.g., a tubular steel case, may be permanently deformed during firing by radial expansion beyond its limits of elastic deformation. In this case, the spent ammunition round may lock in the firing chamber due to resulting interference between the case and the chamber wall. Such interference inhibits rapid, automatic loading and firing.

Telescoped ammunition differs from conventional ammunition in that a conventional cartridge has a tapered case that allows it to be extracted easily from the firing chamber after firing. While the cartridge case of a conventional round typically undergoes some permanent deformation, specifically, radial expansion, as a result of the Pressures developed during firing, the tapered design allows the spent case to be removed from the firing chamber with minimal resistance once the initial breakaway force is overcome. The tapered case of conventional rounds requires, however, that cartridge insertion and subsequent case extraction be accomplished sequentially from the same end of the firing chamber. In contrast, a telescoped cartridge is basically a straight cylinder so that insertion and extraction can occur simultaneously in the same direction at opposite ends of an open-ended firing chamber. Advantageously, this allows the incoming round to be used as the mechanism for pushing the fired case out of the chamber, thereby resulting in considerable simplification of the gun mechanism. Because of the cylindrical shape of the cartridge case, however, the spent case would resist extraction from the chamber even beyond an initial breakaway force if the case had suffered permanent deformation, i.e., radial expansion, during firing.

To prevent permanent deformation of the cartridge case of a telescoped ammunition round, a pressure relief feature or mechanism of some sort is required, whereby firing pressures building up within the case can escape other than merely out the forward end of the case behind the advancing projectile.

It is known to use a plastic case in an automatic fixture for telescoped ammunition. Plastic is not capable, however, without substantial risk of failure, of handling the ballistic cycle loads in a typical firing environment temperature range of −65°F. to +165°F.

It is also known to fabricate the case of a telescoped ammunition round from two sections which then are bonded together. For example, U.S. Pat. No. 3,892,181 to Goldin teaches a flat telescoped cartridge case which is formed of two separate, identical pieces joined by ultrasonic welding. This case, however, presents the same disadvantages mentioned above regarding a solid tubular steel case in that it may be permanently deformed during firing.

In U.S. Pat. No. 4,604,954 to Clarke et al a telescoped ammunition round is disclosed having a pressure relief feature to avoid permanent radial deformation of the casing. Specifically, the tubular casing surrounding the propellant charge has two longitudinal splits dividing the casing into two substantially identical halves. The casing halves can separate during firing and, thus, while sustaining firing pressure created by the propellant charge, avoid permanent deformation. An end cap assembly couples adjacent ends of the halves of the tubular casing to each other. Such dual split cartridge case ammunition rounds, however, while functional, present certain difficulties in establishing a durable hermetic seal. Ammunition rounds must be durable and able to withstand prolonged exposure to a wide variety of environmental conditions and also physical impacts during handling, transportation, etc. It is highly desirable, therefore, to provide a telescoped ammunition cartridge case which provides the necessary pressure relief feature, yet which does not have the disadvantages of the split case described above.

The object of the present invention is to provide a cartridge case for a telescoped ammunition round which satisfies the need for a pressure release feature to avoid casing lock-up in the firing chamber. These and other objects and advantages of the present invention will be understood from the following disclosure and discussion thereof.

SUMMARY OF THE INVENTION

According to the present invention, a telescoped ammunition round cartridge case comprises a generally tubular case wall and an axially extending elongate score line in said wall having a radial depth less than the radial thickness of said wall.

According to another aspect of the invention, a telescoped ammunition round comprises:

a propellant charge having an axial cavity for supplying firing power for the ammunition round;

a projectile housed within the axial cavity; and a hermetically sealed cartridge comprising an axially extending, generally tubular outer case surrounding the propellant charge, the outer case being as described immediately above.

According to a forming tool aspect of the present invention, a score line forming tool for the manufacture of a cartridge case as described above for a telescoped ammunition round comprises:

a right cylindrical working surface;

a circumferentially extending, elongate score line forming ridge projecting radially outwardly from the working surface; and a recess in the working surface extending laterally on both sides of the ridge, the radial dimension of such recesses being small relative that of the ridge.

The telescoped ammunition cartridge case of the present invention provides the necessary pressure relief feature to avoid any significant permanent deformation of the case during firing, and so avoids the problems and disadvantages associated with such permanent deformation as described above. Specifically, the cartridge case of the present invention provides a score line which preferably extends over substantially the entire axial dimension of the outer case. Thus, pressure relief is provided during firing of the telescoped round over substantially the entire axial dimension of the round. Permanent deformation of the case is avoided and the spent case is readily removed from the firing chamber. Additional features and advantages of the present invention will be better understood in the light of the attached drawings and the detailed description of preferred embodiments presented below.

DETAILED DESCRIPTION OF PREFERRED EMBODIMENTS

Figure 1:
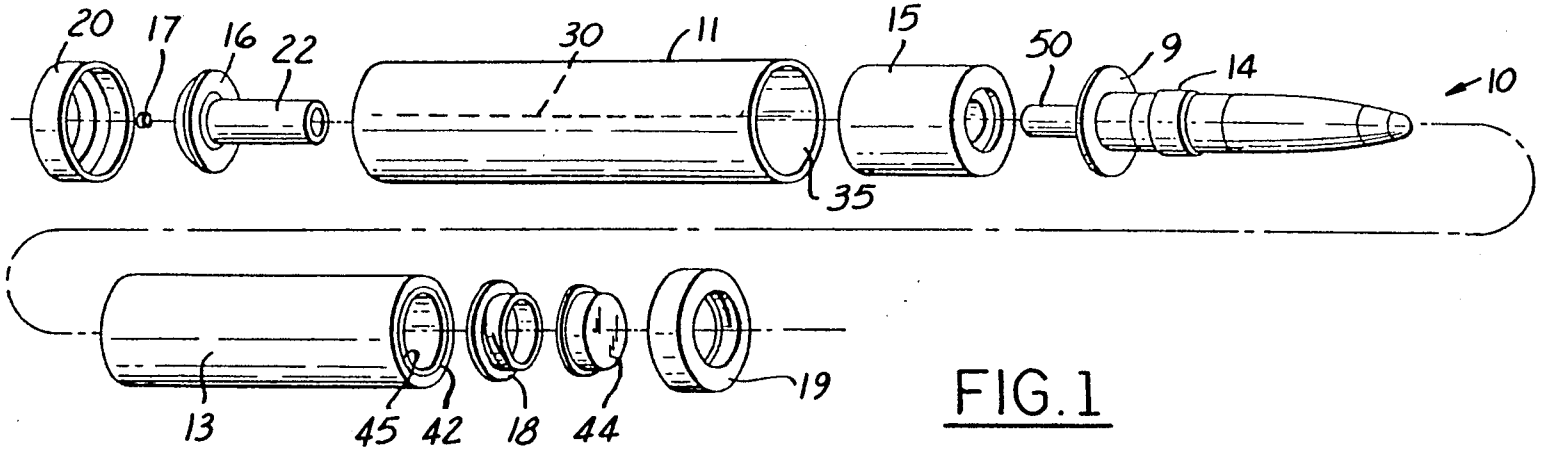
FIG. 1 is an exploded perspective view of a telescoped ammunition round comprising a cartridge case in accordance with an embodiment of this invention.

It will be understood by the skilled in the art in view of those present disclosure that the cartridge case (also referred to herein as an outer case or casing and known to those skilled in the art by various other names) is suitable for use in a broad range of telescoped ammunition rounds. The present invention is not restricted to any particular caliber of telescoped ammunition round. It can be used with both full caliber projectile rounds and sub-caliber projectile rounds. For purposes of exemplification of the invention, a simple full caliber telescoped round is illustrated in the drawings and disclosed and discussed below. Therein the outer case of the round consists of a generally cylindrical tube having the score line feature critical to the present invention. It is to be understood, however, that the invention is not limited to any of the particular features of the embodiment shown in the drawings other than the score line feature. Thus, for example, the particular configuration of the projectile, the propellant charge, the end seal means of the cartridge casing, etc., may be in accordance with any of various design options known to those skilled in the art.

Figure 2:
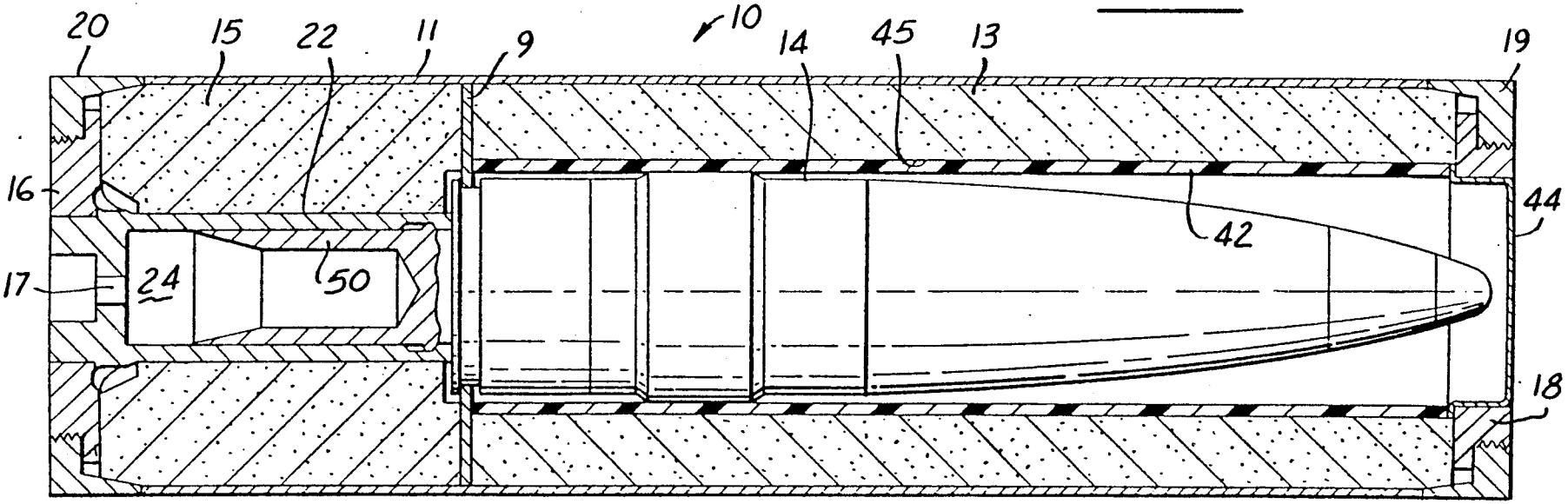
FIG. 2 is a section view of the ammunition round of FIG. 1 shown in assembled form.

Referring to FIGS. 1 and 2, a telescoped ammunition round 10 is seen to include a generally cylindrical outer case 11 having an axial opening at each end for receiving components of the ammunition round. Specifically, ammunition round components loaded into the outer case 11 include forward propellant grain 13 having a generally tubular configuration with a central, open-ended, axial cavity 45. The central axial cavity 45 of propellant 13 receives a projectile assembly 14. An optional cavity-lining tube 42 is shown to surround projectile assembly 14 within cavity 45. Rearward propellant grain 15 is housed within outer case 11 rearward of propellant grain 13. Rear grain propellant 15 also has an open-ended central axial cavity in which is received the forward portion of control tube 22. Generally cylindrical piston 50 optionally may be integral with projectile assembly 14 according to known telescoped ammunition round design techniques. Piston 50 is received coaxially within control tube 22. Optionally, a thermal spacer 9 is included, as shown in FIGS. 1 and 2, between the forward and aft charge grains. In the embodiment depicted, the control tube comprises, in addition to the forward extending axial bore in which is received the piston 50, a rear retainer 16 against which abuts the rear face of rear propellant charge 15. Rearward of piston 50 within axial bore 21 of the control tube is housed a booster charge 24 and primer 17. The telescoped round also has forward and aft annular seals comprising, respectively, forward end seal 19 and rearward end seal 20. Each has an essentially L-shaped cross section (or U-shaped viewing its entire width), that is, each has a radially inwardly extending closure portion with an axially extending portion at its outer Periphery. The closure portion of forward end seal 19 has a radially inwardly facing surface making a threaded joint with forward retainer 18. Forward retainer 18 has a central axial bore, closed by closure disk 44, of diameter sufficient to pass the projectile assembly 14 to a gun barrel. The closure portion of rearward end seal 20 has a radially inwardly facing surface making a threaded joint with the control tube 16. Alternative end closure designs and alternative closure means are known to those skilled in the art and the applicability thereof to the present invention will be apparent in the light of the present disclosure.

Figure 3:
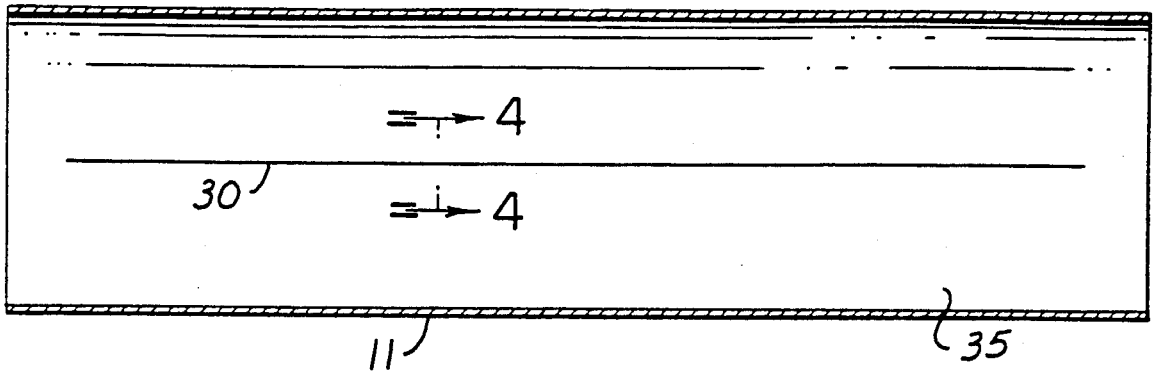
FIG. 3 is a section view showing the interior surface of the cartridge case of the telescoped ammunition round of FIGS. 1 and 2.
Figure 4:
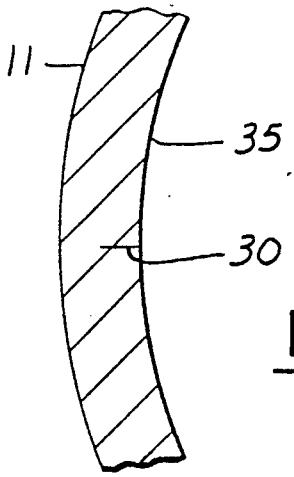
FIG. 4 is a section view, enlarged and partially broken away, taken through line 4—4 in FIG. 3 and showing the relative radial dimension of the wall of the cartridge case and the fracture line or score line therein.

The tube 11 of the cartridge casing is now described with greater particularity with reference also to FIGS. 3 and 4. In this regard, however, it is to be understood that the present invention is not limited to the particular features thereof other than the score line pressure relief feature disclosed herein. Thus, for example, it is operable but optional that both forward and aft annular seals 19 and 20 are interchangeable and have an L-shaped cross-section with a threaded area on the smallest diameter.

The outer case 11 is seen to have axially extending elongate score line 30 (shown in phantom in FIG. 1) having an axial dimension approximately equal to the overall axial dimension of the tube. It is preferred that the score line extend approximately to the end of the tube at both ends.

The score line can be formed in accordance with techniques known to the skilled of the art and may be any suitable, localized weakening of the cylindrical tube of the outer case of the ammunition round. According to a preferred embodiment, the outer case is fashioned of suitable metal, such as brass or steel, for example, or any of numerous other suitable metal alloys known to those skilled in the art. Such an outer case can be formed by seam welding a flat sheet of the metal followed by various known trimming operations to provide a smooth round tube. The tube may then be reduced in diameter, such as by single or double reduction draws. Typically, a double reduction draw may result in about a 70% increase in tube longitudinal dimension with about a 20% reduction in tube circumferential dimension. According to a preferred embodiment, the score line may be formed by impressing an indentation into the surface of the sheet material prior to seam welding to form the tube. Preferably, such indentation is V-shaped and extends into the sheet material approximately one-half its thickness. This provides the necessary weakening of the outer case of the ammunition round cartridge to provide the pressure relief feature needed to avoid permanent deformation of the case during firing of the round. It allows the ammunition round, however, to be hermetically sealed, with appropriate joining of the outer case to sealing means at each end of the ammunition round, since the outer surface of the casing remains continuous and unbroken until the round is fired.

As noted above, the score line provides pressure relief along the axial dimension of the round. During firing of the round, the outer case will fracture at the score line and a gap will occur. The gap will be widest at the center and narrower at the ends of the score line. Thus, greater pressure relief is provided at the center of the score line than at its ends.

Referring particularly to FIG. 4, a cross-sectional view of the wall of an outer casing is seen with a score line therein. When the score line segment comprises a V-shaped indentation formed in the surface of sheet metal, specifically, that surface which will be the inside surface of the tube, the indentation has a tendency to close as a result of the tube forming operations. In fact, it is preferable that the originally formed indentation be sufficiently narrow that in the final casing it is no more than a hairline fracture in the inside surface of the tube. Thus, in the section view of FIG. 4 the score line segment 30 formed in the inside surface 35 of outer case 11 appears as a fracture of essentially uniform width extending radially into the cartridge case wall approximately one-half the thickness of the tube wall, but preferably not less than one-half, most preferably about 50% to about 70% of the wall thickness.

It will be understood by those skilled in the art in view of the present disclosure that all of the components of the telescoped ammunition round 10 can be fabricate using methods and materials well known to those skilled in the art. Thus, for example, it will be apparent that the control tube can be constructed of high strength material such as 17-4 Ph stainless steel or the like. It also will be understood that the present invention is not limited to materials and fabrication techniques presently known, but rather also includes those applicable to the invention which may be developed at any future time.

Figure 5:
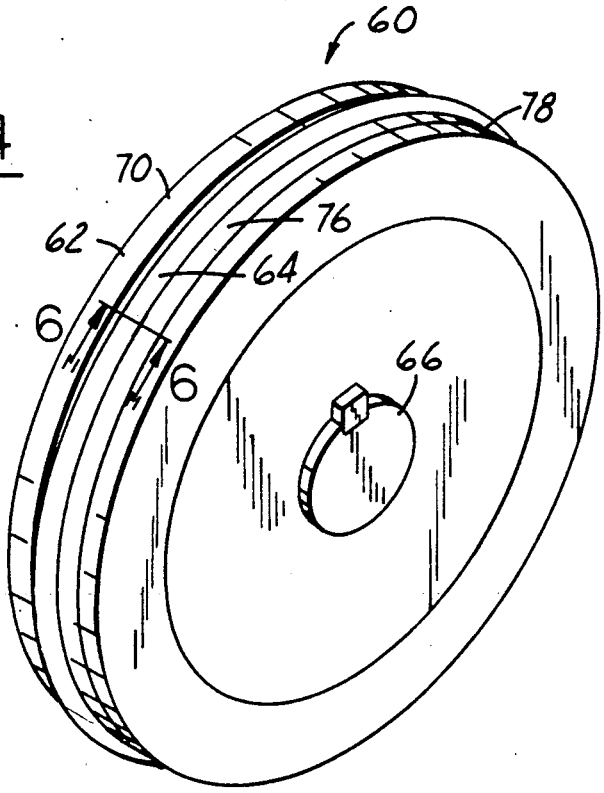
FIG. 5 is a perspective view of a forming tool suitable for use in the production of a cartridge case of the invention.

According to another aspect of the invention, a score line forming tool is provided for manufacturing an outer case of the invention as described above. Specifically, referring now to FIGS. 5 and 6, a score line forming tool 60 is shown to comprise a right cylindrical working surface 62. This working surface 62 is rolled over sheet metal which will be seam welded to form a tube used as an outer case of a telescoped ammunition round in accordance with the present invention. Working surface 62 is seen to comprise a circumferentially extending, elongate score line forming ridge 64 projecting radially outwardly from the working surface. It will be appreciated by those skilled in the art that the lateral width and the dimension of radial projection of the ridge is dictated by the correlative dimensions desired for the score line in the finished cartridge case. For a typical 20mm telescoped ammunition round, the ridge would preferably be, for example, approximately 0.02 inch in radial height projection with thickness at the base of the V-shaped ridge determined by the angle alpha being approximately 30°.

Figure 6:
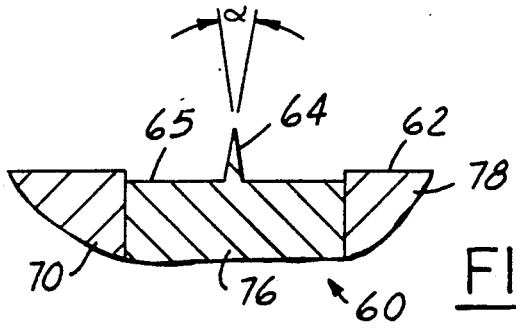
FIG. 6 is a section view, exploded and partially broken away, taken through line 6—6 of FIG. 5 and showing a score line forming ridge and the relative radial dimension of such ridge and of a recess on either side thereof.

Another feature of the score line forming tool can be seen in FIG. 6. Specifically, on either side of each ridge 64 is a radial recess 65 below the adjacent level of the working surface of the tool. Such recess is provided to permit expansion of the surface of the sheet metal as the indentation is being formed. It will be within the ability of those skilled in the art to determine a suitable depth for such recess. For a ridge of the dimensions given above, a suitable recess would be, for example, 0.005 inch. It will be understood in view of the discussion above that the dimensions of the score line in the finished product typically will be considerably different and smaller than those of the score line forming ridges as a result of subsequent processing, including rolling and seam welding, reduction drawing, surface finishing, etc.

The working tool 60 preferably is formed as a sandwich of disks or donut shaped wafers, each with a keyed hub 66 or the like to maintain proper alignment. A first disk 70 is seen to provide an outer edge of the main working surface of the tool. Disk 76 lies adjacent disk 70 and carries ridge 64. It has a recessed surface 65 around the ridge as described above. Finally, outer disk 78 establishes the non-recessed working surface of the tool on the side of the tool opposite disk 70.

Various modifications and variations of the several aspects of the invention will be apparent to the skilled of the various arts to which this invention pertains in the light of this disclosure. Such modifications and variations are properly considered within the scope of this invention as defined in the appended claims.

I claim:

1. A telescoped ammunition round cartridge case comprises a generally tubular case wall and an axially extending elongate score line in said wall having radial depth less than the radial thickness of said wall, said score line being in a radially inside surface of said wall and being defined by two oppositely extending sides which contact each other to form a hairline fracture.

2. The cartridge case of claim 1 wherein said score line extends radially into said well approximately 50% to 70% of the thickness thereof.

3. A telescoped ammunition round comprising:

a propellant charge having an axial cavity for supplying firing power for the ammunition round;

a projectile housed within said axial cavity; and a hermetically sealed cartridge case comprising an axially extending, generally tubular case wall surrounding said propellant charge, said case wall having an axially extending elongate score line therein, said score line having a radial depth less than the radial thickness of said wall, said score line being in a radially inside surface of said case wall and being defined by two oppositely extending sides which contact each other to form a hairline fracture.

4. The telescoped ammunition round of claim 3 wherein said score line extends along substantially the entire axial dimension of said case wall.

* * * * *